US005180325A

United States Patent [19]

Eddins et al.

[11] Patent Number: 5,180,325

[45] Date of Patent: Jan. 19, 1993

[54] POSEABLE HAIR STRAND FOR TOY DOLL

[75] Inventors: Fred D. Eddins, Mapleville, R.I.; Maureen Patterson, Wayland, Mass.

[73] Assignee: Hasbro, Inc., Pawtucket, R.I.

[21] Appl. No.: 754,959

[22] Filed: Sep. 4, 1991

[51] Int. Cl.[5] ..... A63H 3/44

[52] U.S. Cl. ..... 446/385; 446/394; 132/53; 428/16; 428/542.2

[58] Field of Search ..... 446/394, 385, 296, 319, 446/372, 373, 374; 428/15, 16, 542.2; 132/201, 53, 56; 87/8

[56] References Cited

U.S. PATENT DOCUMENTS

| | | | |
|---|---|---|---|
| 54,116 | 4/1866 | Cook | 132/53 |
| 1,004,130 | 9/1911 | Wolkow | 132/201 |
| 1,403,792 | 1/1922 | Levussove | 132/201 |
| 2,542,645 | 2/1951 | Eiberle | 132/56 |
| 2,655,923 | 10/1953 | Gallenkamp | 132/7 |
| 3,955,587 | 5/1976 | Dunn et al. | 132/53 |
| 4,170,921 | 10/1979 | Repass | 87/8 X |
| 4,302,491 | 11/1981 | Papageorgiou | 132/53 X |

*Primary Examiner*—Mickey Yu
*Attorney, Agent, or Firm*—Salter, Michaelson & Benson

[57] ABSTRACT

A poseable hair strand for a toy doll includes a ductile and formable center core fiber and an outer casing on the center core fiber. The center core fiber preferably includes a multifilament yarn fiber which is impregnated with a relatively soft formable paraffinic wax material, and the outer casing preferably includes a plurality of multifilament yarn fibers which are substantially unimpregnated with the wax material and formed in a tubular braid configuration around the core fiber.

15 Claims, 2 Drawing Sheets

POSEABLE HAIR STRAND FOR TOY DOLL

BACKGROUND AND SUMMARY OF THE INVENTION

The instant invention relates to toy dolls, and more particularly to a poseable hair strand for a toy doll.

A variety of different types of hair strands have been heretofore available for toy dolls. However, most of the previously available hair strands have been constructed from relatively thin, flexible monofilament fibers, such as monofilament nylon. In this connection it has been found that fibers such as monofilament nylon fibers can be effectively utilized to provide flexible hair strands which are both relatively attractive and durable. However, while hair strands of this type have been found to be relatively realistic, they have generally not been found to be formable into various set dispositions to provide specific set hairstyles, since they generally do not retain set configurations when positioned in specific orientations. Hence, it has generally not been possible to form the hair strands of most heretofore available toy dolls into realistic set hair styles.

The instant invention provides a novel hair strand which is poseable or formable into various set dispositions and which remains in a set configuration once positioned in a desired orientation. Specifically, the poseable hair strand of the instant invention comprises a core fiber which preferably comprises a multifilament core fiber impregnated with a relatively soft pliable and formable wax material. The poseable hair strand further comprises an outer casing on the core fiber comprising a plurality of fibers which are substantially unimpregnated with the wax material. The fibers in the casing preferably also comprise multi-filament fibers and they are preferably formed in a relatively tight tubular braid configuration around the impregnated core fiber. Further, the wax material preferably comprises a formable paraffinic hydrocarbon wax mixture having a melting point of at least approximately 130° F. and an ASTM D1321 needle penetration of between 15 mm and 35 mm at 77° F.

It has been found that the poseable hair strand of the instant invention can be effectively utilized in a toy doll and that it effectively retains a set disposition once formed. In this connection, it has been found that the impregnated center core fiber can effectively retain the hair strand in a set orientation once the strand is manually positioned in a desired configuration. It has been further found that because the poseable hair strand includes an outer casing on the core fiber made from a plurality of unimpregnated fibers the poseable hair strand does not normally have a waxy feel, and it is not prone to causing stains on clothing and the like.

Hair strands and the like representing the closest prior art to the subject invention of which the applicant is aware are disclosed in the U.S. Pat. Nos. 1,004,130 to Wilkow; 1,403,792 to Levussove; 2,655,923 to Gallenkamp; and 3,955,587 to Dunn et al. However, since these references clearly fail to suggest the concept of providing a hair strand comprising a formable center core fiber which is impregnated with a wax-like material and an outer casing comprising a plurality of unimpregnated fibers on the center core fiber, they are believed to be of only general interest with respect to the subject invention.

Accordingly, it is a primary object of the instant invention to provide an effective poseable hair strand for a toy doll.

Another object of the instant invention is to provide a poseable hair strand comprising a center core fiber which is impregnated with a soft pliable and formable wax material, and an outer casing comprising a plurality of substantially unimpregnated fibers on the center core fiber.

An even further object of the instant invention is to provide a poseable hair strand which does not have a waxy feel.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
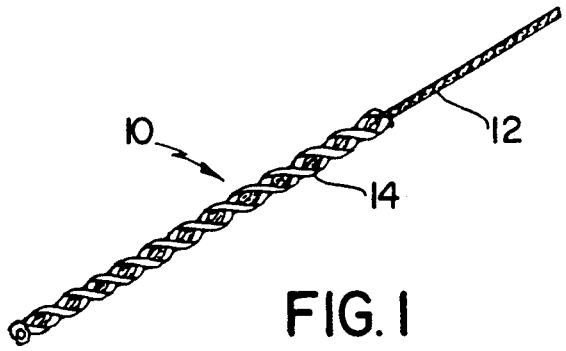
FIG. 1 is an enlarged view of the hair strand of the instant invention illustrating both the center core thereof, and the outer casing thereof.
Figure 2:
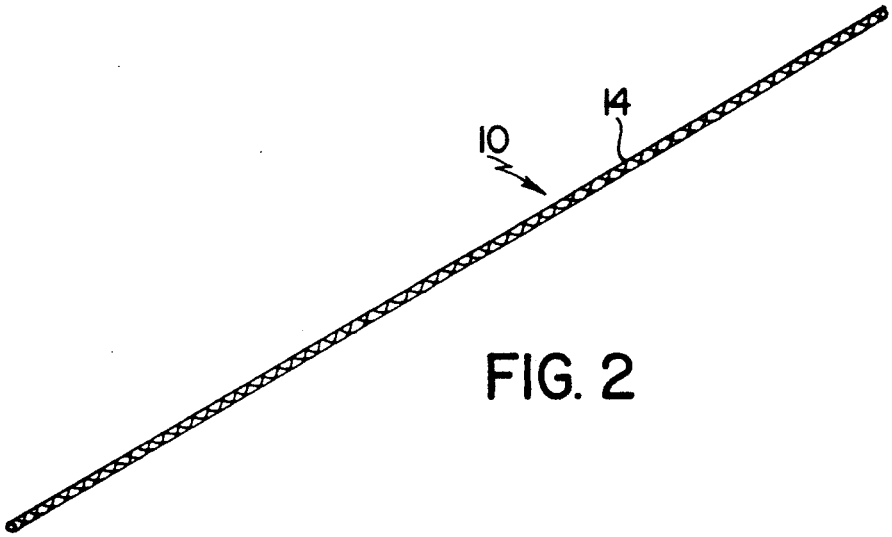
FIG. 2 is a view of the hair strand in a substantially straight disposition.
Figure 3:
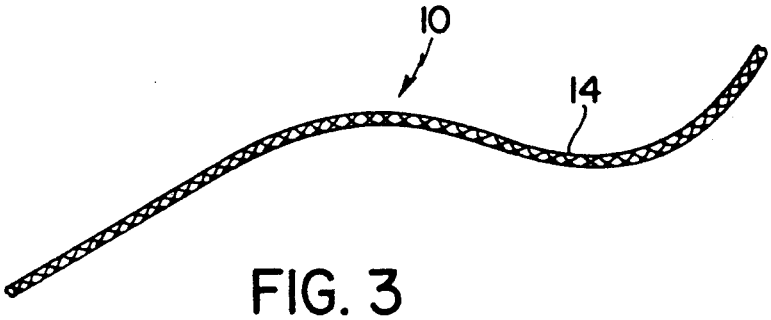
FIG. 3 is a view of the hair strand in a curled disposition.
Figure 4:
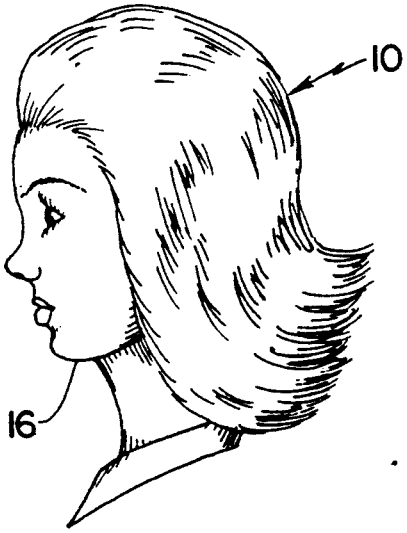
FIG. 4 is a side elevational view of the head portion of a toy doll with a plurality of the hair strands thereon.

Referring now to the drawings, the poseable hair strand of the instant invention is illustrated and generally indicated at 10 in FIGS. 1 through 4. The poseable hair strand 10 comprises a core fiber 12 which is impregnated with a relatively soft pliable and formable wax material and an outer casing 14 on the core fiber 12. The hair strand 10 is adapted so that it is poseable under normal temperature conditions to enable it to be formed and retained in various set configurations. Accordingly, as illustrated in FIG. 4, when a plurality of the hair strands 10 are assembled on the head portion of a toy doll 16, the hair strands 10 can be formed into various configurations to provide various different set hair styles for the doll 16. In this connection, however, it will be understood that the term "doll" as utilized herein is intended to include both human and animal figures and that applications wherein the hair strands 10 are applied to various different portions of the bodies of animal doll figures are contemplated.

The core fiber 12 comprises a ductile and formable fiber which preferably comprises a synthetic multifilament yarn such as a polyethylene or acrylic yarn, although the use of a variety of other synthetic and natural yarns and fibers for the core fiber 12 is also contemplated. The core fiber 12 is preferably impregnated with a suitable non-hardening formable plastic wax material which preferably comprises a paraffinic hydrocarbon wax mixture. The wax is preferably selected so that it remains flexible over a temperature range of between 0° F. and 110° F. and it preferably has a melting point of over 130° F. The core fiber 12 as herein embodied comprises a paraffinic hydrocarbon wax mixture of the general type commonly utilized in model making having a melting point of 175° F. and an ASTM D1321 needle penetration of 26 mm at 77° F. However, the use of other waxes having ASTM D1321 needle penetrations of between 15 mm and 35 mm at 77° F. is contemplated. In any case, the wax is preferably also non-toxic, free of heavy metals, and non-irritating so that it can be effectively incorporated into a toy doll without adverse effects.

The outer casing 14 comprises a plurality of multifilament fibers which are substantially unimpregnated with the wax material and braided in a relatively tight conventional tubular braid configuration on the center core fiber 12 so that the outer casing 14 substantially covers the core fiber 12. The outer casing preferably comprises fibers made from polyethylene or acrylic yarn, although the use of a variety of other synthetic or natural yarns and/or fibers is contemplated.

In actual use a plurality of the strands 10 are secured to a doll such as the doll 16, so that the strands 10 extend outwardly from the scalp area of the head of the doll 16. Although the strands 10 are normally of somewhat larger diameter than conventional hair fibers they have the advantage that they can be effectively formed into various configurations to apply various styles to the hair of the doll 10. For example, the hair strands 10 can be effectively curled around a mandrel and once the mandrel is removed the hair strands 10 retain curled configurations. The hair strands 10 can also be formed into virtually any other desired configuration and therefore they significantly enhance the play value of the doll 16.

It is seen therefore that the instant invention provides an effective hair strand for a toy doll. In this regard, a plurality of hair strands 10 as assembled in the doll 16 can be effectively formed into various set configurations. Further, because the hair strands 10 comprise impregnated core fibers 12 and outer casings 14 made from unimpregnated fibers, the hair strands 10 do not normally have a waxy feel. Accordingly, the hair strand 10 represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A poseable hair strand for a toy doll comprising:

a) a core fiber which is ductile and manually formable into various desired set configurations, said core fiber being impregnated with a relatively soft, pliable and formable wax material; and b) an outer casing on said core fiber, said outer casing comprising a plurality of fibers which substantially cover said core fiber and which are substantially unimpregnated with said wax material.

2. A toy doll comprising a head having a scalp portion and a plurality of hair strands attached to said doll so that they extend outwardly from said scalp portion, said hair strands each comprising:

(a) a core fiber which is ductile and manually formable into various desired set configurations; and (b) an outer casing on said core fiber, said outer casing comprising a plurality of fibers which substantially cover said core fiber.

3. In the poseable hair strand of claim 1, said core fiber comprising a multifilament fiber.

4. In the poseable hair strand of claim 1, said outer casing comprising a plurality of multifilament fibers which are substantially unimpregnated with said wax material.

5. In the poseable hair strand of claim 3, said outer casing comprising a plurality of multifilament fibers which are substantially unimpregnated with said wax material.

6. In the poseable hair strand of claim 1, said outer casing comprising a plurality of fibers which are substantially unimpregnated with said wax material and braided in a tubular braid configuration around said core fiber.

7. In the poseable hair strand of claim 1, said outer casing comprising a plurality of multifilament fibers which are substantially unimpregnated with said wax material and braided in a tubular braid configuration around said core fiber.

8. In the poseable hair strand of claim 1, said outer casing comprising a plurality of fibers which are formed in a tubular braid configuration around said core fiber.

9. In the poseable hair strand of claim 3, said outer casing comprising a plurality of multifilament fibers which are substantially unimpregnated with said wax material and braided in a tubular braid configuration around said core fiber.

10. In the poseable hair strand of claim 1, said wax material having a melting point of at least approximately 130° F. and remaining flexible and formable over a range of between 0° F. and 110° F.

11. In the poseable hair strand of claim 1, said wax material comprising a paraffinic hydrocarbon wax.

12. In the poseable hair strand of claim 1, said wax material having an ASTM D1321 needle penetration of between 15 mm and 35 mm at 77° F.

13. In the poseable hair strand of claim 12, said wax material having a melting point in excess of 130° F.

14. A plurality of the poseable hair strands of claim 1, in combination with a toy doll head having a scalp portion, said hair strands being attached to said toy doll head so that they extend outwardly from said scalp portion.

15. A poseable hair strand for a toy doll comprising:

a) a core fiber which is ductile and manually formable into various desired set configurations, said core fiber being impregnated with a relatively soft, pliable and formable wax material; and b) an outer casing on said core fiber, said outer casing comprising a plurality of fibers which substantially cover said core fiber.

* * * * *